United States Patent [19]

Beyl

[11] 4,342,468

[45] Aug. 3, 1982

[54] SKI BRAKE

[75] Inventor: Jean J. A. Beyl, Nevers, France

[73] Assignee: Ste Look, Nevers, France

[21] Appl. No.: 186,952

[22] Filed: Sep. 15, 1980

Related U.S. Application Data

[63] Continuation-in-part of Ser. No. 23,035, Mar. 23, 1979, abandoned.

[30] Foreign Application Priority Data

Apr. 15, 1978 [FR] France ..... 78 10039

[51] Int. Cl.[3] ..... A63C 7/10

[52] U.S. Cl. ..... 280/605

[58] Field of Search ..... 280/605, 604, 612, 12 AB, 280/618; 188/5

[56] References Cited

U.S. PATENT DOCUMENTS

| | | | |
|---|---|---|---|
| 3,704,024 | 11/1972 | Martin | 280/605 |
| 3,794,339 | 2/1974 | Smolka | 280/612 |
| 3,899,185 | 8/1975 | Martin | 280/605 |
| 4,063,751 | 12/1977 | Salomon | 280/605 |
| 4,066,276 | 1/1978 | Salomon | 280/605 |
| 4,140,331 | 2/1979 | Salomon | 280/612 |

FOREIGN PATENT DOCUMENTS

| | | | |
|---|---|---|---|
| 1428881 | 12/1968 | Fed. Rep. of Germany | 280/605 |

*Primary Examiner*—David M. Mitchell

*Attorney, Agent, or Firm*—Linda G. Bierman; Jordan B. Bierman

[57] ABSTRACT

A ski brake fitted on the heel-retaining unit of a ski binding has two rotatable arms actuated by a battery-powered reversible electric motor which is engaged with an arm-actuating mechanism. A double-throw contactor associated with the actuating mechanism co-operates with a spring-loaded pusher. When the ski boot is inserted in the ski binding, the pusher is moved away from the contactor and the motor produces a pivotal displacement of the arms to their inactive position. When the boot becomes detached from the binding, the pusher spring applies the pusher against the contactor, the motor is started-up and produces a pivotal displacement of the arms to their active braking position.

8 Claims, 17 Drawing Figures

SKI BRAKE

This is a continuation-in-part of my application Ser. No. 23,035, filed Mar. 23, 1979, and now abandoned.

This invention relates to a ski brake, that is to say a braking device which is intended to be mounted on a ski in order to prevent it from sliding on the snow after it has become detached from a ski boot, for example after a skier has fallen and produced a release of the associated ski binding.

The ski brakes which are in most general use have two braking arms placed on each side of the ski and coupled together by means of a cross-pin on which the arms are pivotally mounted. One end of each arm is intended to penetrate into the snow whilst the opposite end is provided with an extension in the form of a stirrup-piece which is intended to be actuated by the ski boot. Said arms also tend to return to their active position under the complementary action of elastic restoring means. Ski brakes of this type are therefore automatic or in other words are automatically moved to their inactive position as a result of a simple boot-resetting operation performed by the skier. The brakes are provided with relatively complex and cumbersome mechanical control elements placed between the boot and the ski.

In order to actuate these control elements, the skier has to exert a relatively high effort on said elements at the time of boot-resetting since he has to overcome the resilient force which maintains the brake in the active position. As a consequence, boot-resetting is not a convenient operation. Furthermore, in the majority of known ski brakes, the above-mentioned resilient force continues to be applied against the ski boot even when this latter is in position within the ski binding. There is thus exerted on the ski boot a parasitic force which tends to thrust the boot out of the binding and is transmitted to this latter, with the result that perfect operation of the ski binding is liable to be impaired.

The aim of the invention is to overcome this drawback by producing a ski brake which does not exert any parasitic or undesirable force on the boot while skiing is in progress.

The ski brake contemplated by the invention and intended to be associated with a ski binding comprises two rotatable braking arms associated with control means for moving said arms from an inactive position to an active braking position.

In accordance with the invention, the control means comprise a reversible electric motor supplied from a battery and engaged with a rotary drive unit associated with a contactor, said contactor being adapted to cooperate with a pusher which is in turn acted upon by a resilient restoring member. These elements are so arranged that, when the boot is in position within the ski binding, it is applied against the pusher and holds this latter away from the contactor whilst the motor is supplied with current in the direction which initiates operation of the arm-actuating unit so as to produce a rotational displacement of the arms to their inactive position and that, when the boot becomes detached from the ski binding, the pusher-restoring member brings said pusher against the contactor. Said contactor then initiates the operation of the motor and the arm-actuating unit in a direction which produces a pivotal displacement of the arms to their active braking position.

The arrangement of electrical control means permits elimination of mechanical restoring members, thus constituting an advantage since these latter produce a resilient force which proves objectionable in most ski brakes of known types.

In one embodiment of the invention, the contactor is a double-throw changeover contactor. Switching of said contactor to either of its two positions is initiated by the pusher so as to cause rotation of the motor as well as the arm-actuating unit either in one direction or in the other.

In accordance with another distinctive feature of the invention, the arm-actuating unit comprises an output pinion in coaxial relation with an output shaft driven by the motor and adapted to cooperate with a set of pinions, two of which are capable of driving the braking arms in rotation. Said actuating unit is associated with means for automatically stopping the motor on completion of the movement of pivotal displacement of the braking arms to either the active position or the inactive position.

In a preferred embodiment, the means for automatically stopping the motor comprise a cam rigidly coupled for rotation with the output shaft of the motor and adapted to cooperate with two switches placed in the electric circuit of the motor so as to ensure that closing of one of the switches by the cam whilst the other switch is opened permits the supply of current to the motor and correlatively the movement of rotation of the arms towards either of their two positions until the cam has pivoted through a predetermined angle, opens said switch and closes the other switch while interrupting the supply of current to the motor, thus automatically stopping the rotation of the braking arms either in their active position or in their raised inactive position.

The brake can be integrated with a front stop or with a heel-retaining unit, in which case the arm-actuating drive unit is housed within the body of the ski binding.

The braking arms can be elbowed, in which case they are substantially L-shaped, and are capable of pivoting on a pin located near the end of each short branch of said arms, said short branches being applied against the surface of the ski.

The resilient restoring member which produces action on the pusher in order to urge this latter towards the contactor can be a helical spring, for example. The extremely low force of said spring exerts a negligible thrust on the sole of the boot and practically does not give rise to any parasitic force.

Other features and advantages of the invention will become apparent upon consideration of the following description, reference being made to the accompanying drawings in which one embodiment of the invention is illustrated by way of example without any limitation being implied, and in which.

Figure 1:
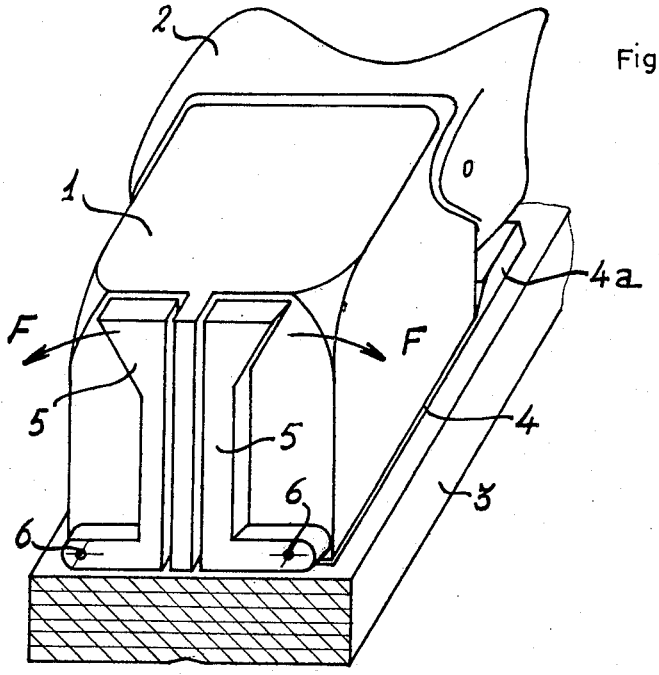
FIG. 1 is a perspective view on the rear end of a heel-retaining unit equipped with a ski brake in accordance with the invention and in the inactive position.

The heel-retaining unit shown in FIGS. 1 to 6 comprises a body 1 on which is pivotally mounted in a manner known per se an end-piece 2 or heel grip which is adapted to maintain the rear end of the ski boot (not shown in the drawings) on the ski 3.

The heel-retaining unit 1 is mounted on the ski 3 with interposition of a plate 4, the front portion 4*a* of which serves as a support for the heel of the boot. The safety trip mechanism which serves to release the heel-retaining unit 1 and is mounted within this latter is known per se and has therefore not been shown in the drawings.

Figure 2:
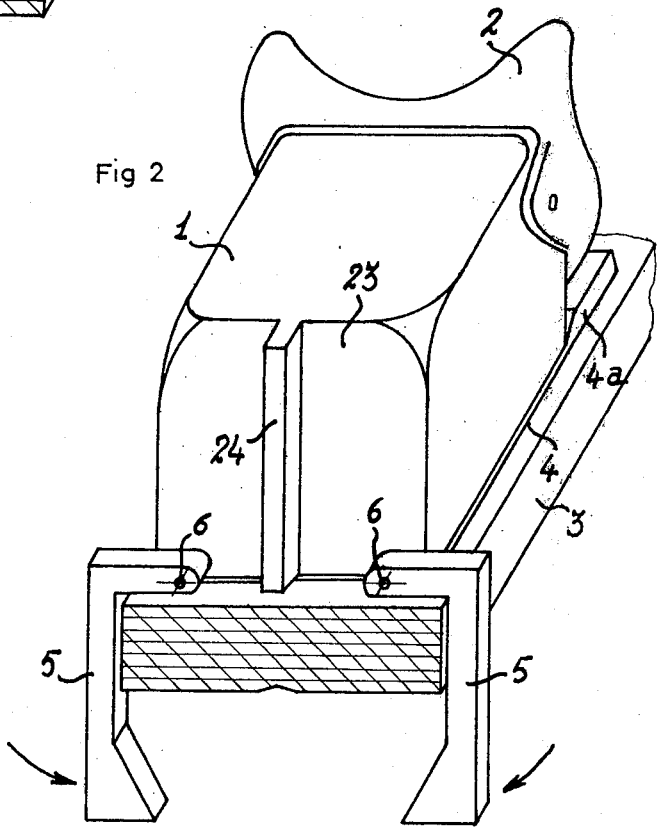
FIG. 2 is a view which is similar to FIG. 1 and shows the brake in the active position.

The ski brake which is fitted on the heel-retaining unit 1 has two arms 5 placed against the rear face of said heel-retaining unit and rotatably mounted on pivot-pins 6 which are parallel to each other and to the longitudinal axis of the ski 3. Said arms are elbowed and designed substantially in the shape of an L in the example shown. The short branch of each L-shaped arm bears on the surface of the ski 3 both when the ski brake is in the inactive position as shown in FIG. 1 and when said brake is in the active position as shown in FIG. 2. Between these two positions, the arms 5 have each performed a pivotal movement about their pivot-pins 6 through an angle of approximately 180° and in an outward direction with respect to the ski as shown by the arrows F.

In accordance with the invention, the aforementioned control means are electrical and comprise a reversible drive unit 7 which is housed within the body 1 of the heel-retaining unit and fixed on the plate 4. Said drive unit 7 is preferably of the electromagnetic type and will be designated hereinafter as a motor. Said motor is so designed that it can be actuated in one direction by the release of the ski boot and in the other direction by fitting said boot within the ski binding in order to cause the arms 5 to move respectively from their inactive position (shown in FIG. 1) to their active position (shown in FIG. 2) and conversely.

Figure 7:
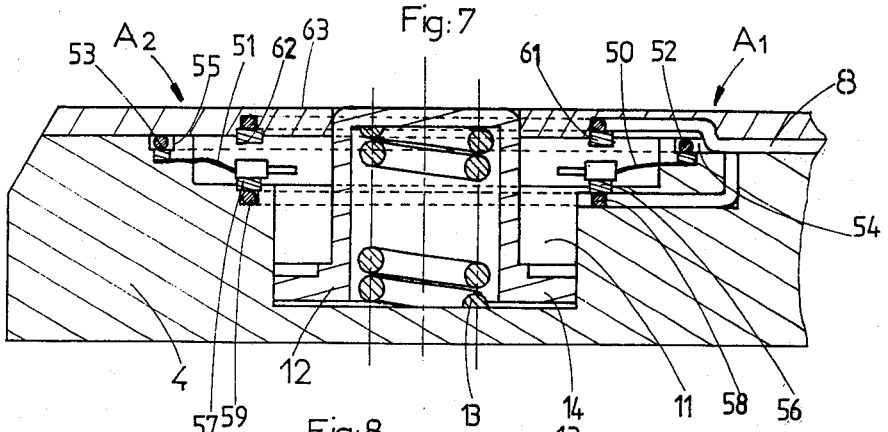
FIG. 7 is a vertical sectional view to a larger scale showing the pusher and associated doublethrow changeover contactor, the pusher having been thrust downwards to its bottom position by the ski boot.
Figure 8:
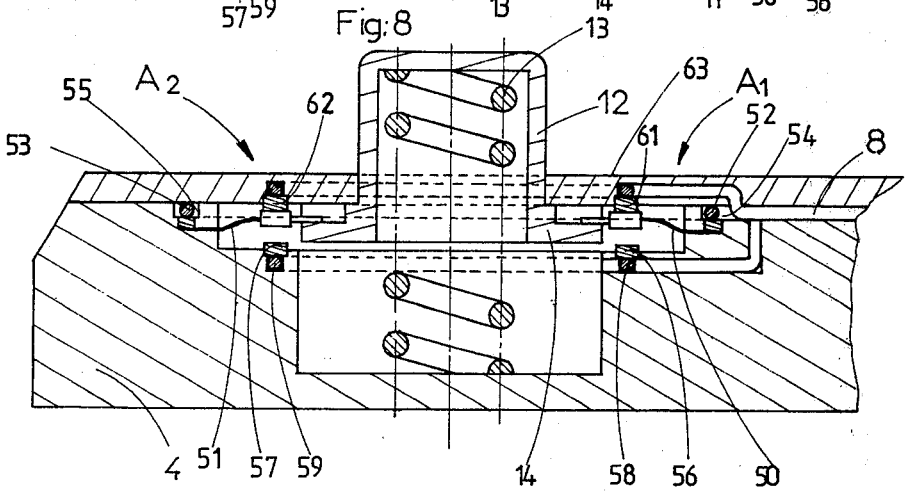
FIG. 8 is a view which is similar to FIG. 7, showing the pusher in the uplifted position in which it has produced a displacement of the associated contacts.

The motor 7 is connected by means of a conductor 8 placed within the plate 4 to a contactor consisting of a double-throw changeover switch A1, A2 shown in detail in FIGS. 7 and 8. Said contactor is mounted at the top portion of a housing 11 formed in the front portion 4*a* of the plate 4 which is of greater thickness at this point than the remainder of the plate.

In the form of construction shown in the drawings, the double-throw changeover contactors A1, A2 are constituted by conductive resilient strips 50, 51. The ends of said strips are inserted in the top portion of the plate 4 and soldered to leads 52, 53 which are inserted within grooves or channels 54, 55 formed in the support plate 4. The resilient strips 50, 51 have a natural curvature which has the effect of applying their opposite ends against bottom contact studs 56, 57 which are rigidly fixed to the plate 4 and soldered to leads 58, 59 which are inserted in the plate 4 and connected to the conductor 8.

Above the contact studs 56, 57 are placed contact studs 61, 62 which are attached to a cover 63 of the housing 11, said studs 61, 62 being soldered to leads which are connected to the conductor 8.

Figure 4:
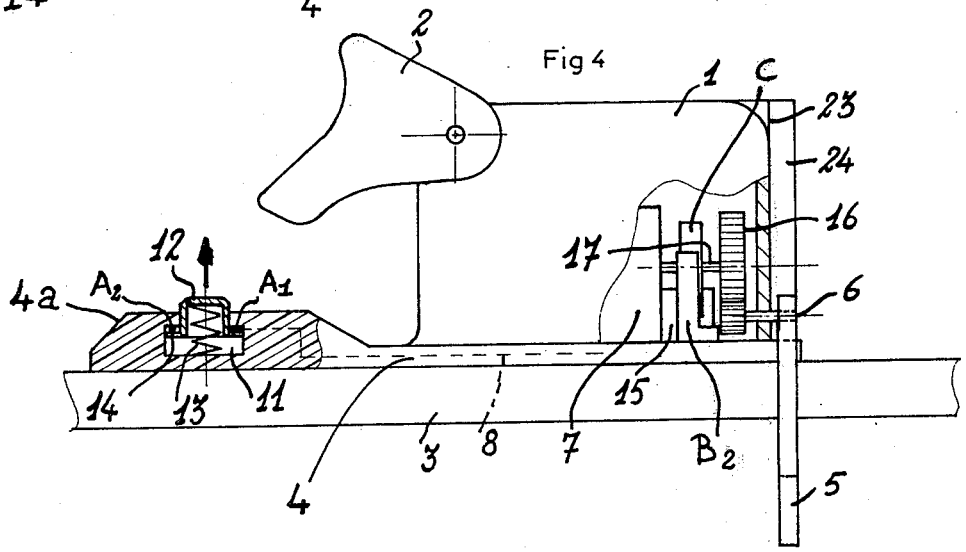
FIG. 4 is a view which is similar to FIG. 3 and shows the ski brake in the active position.
Figure 5:
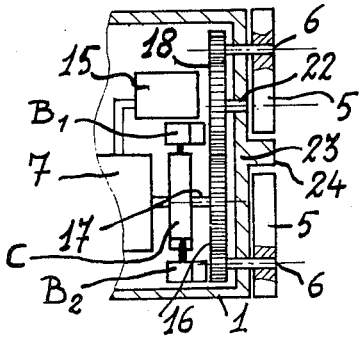
FIG. 5 is a part-sectional view taken along line V—V of FIG. 3.
Figure 6:
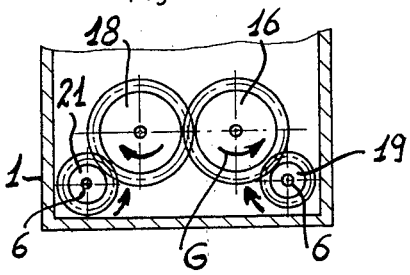
FIG. 6 is a transverse sectional view taken along line VI—VI of FIG. 3.

The double-throw changeover contactor A1, A2 is adapted to cooperate with a pusher 12 placed within the housing 11 and urged by a resilient restoring member in the upward direction, namely towards the switching elements A1, A2 of the contactor. In the example which is illustrated in the drawings, said restoring member is a helical spring 13 mounted within the pusher 12 and applied against the central portion of the bottom endwall of the housing 11. In order to permit upward displacement of the pusher 12, the cover 63 is pierced by an opening which has a cross-sectional area corresponding to that of the pusher. This latter has a peripheral annular flange 14 which is abuttingly applied against the ends of the resilient strips 50, 51 when the pusher 12 is in the top position (as shown in FIGS. 4 and 8).

Figure 3:
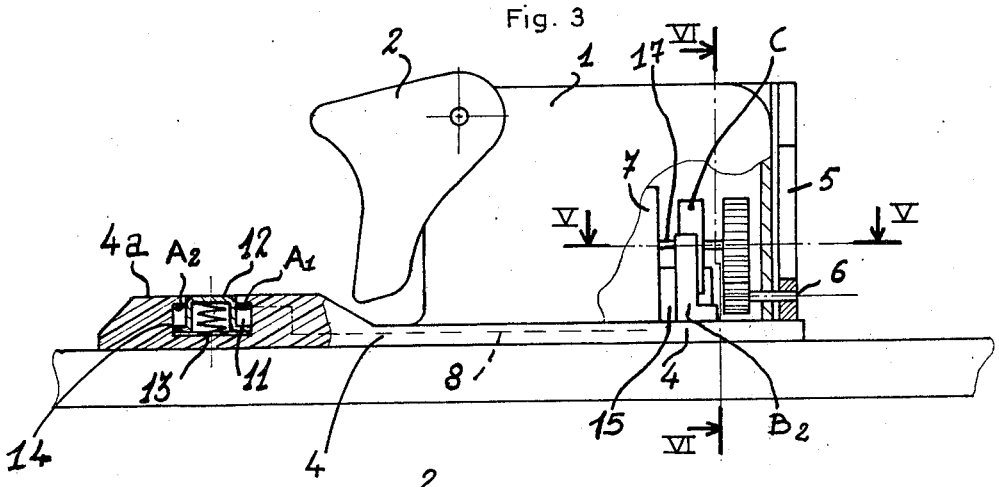
FIG. 3 is a fragmentary part-sectional view in longitudinal elevation showing the heel-retaining unit of FIGS. 1 and 2, the ski brake being in the inactive position.

When the ski boot bears on the front portion of the support plate 4, it causes the pusher 12 to remain in the bottom position within the housing 11, the annular flange 14 of said pusher being thus held away from the contacts A1, A2 (as shown in FIGS. 3 and 7). When the boot is not in position within the ski binding, the restoring spring 13 urges the pusher 12 in the upward direction and the pusher flange 14 is accompanied in its upward displacement by the ends of the resilient strips 50, 51 of the switching elements A1, A2 until said ends are applied against the contact studs 61, 62, the annular flange 14 being stopped in a position of abutting contact with the cover 63 (as shown in FIGS. 4 and 8).

Figure 10:
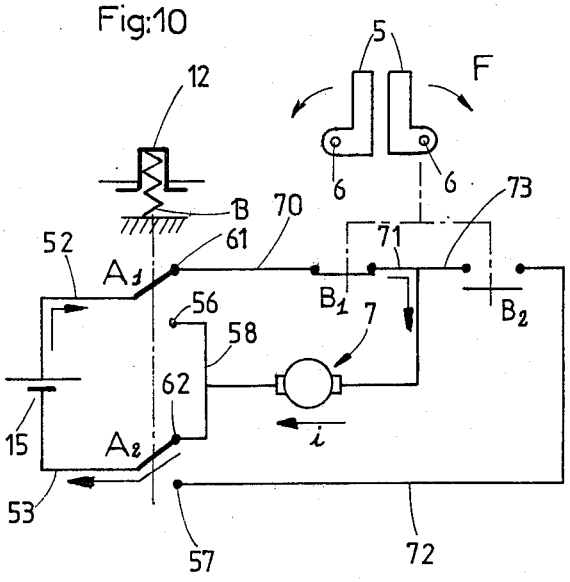
FIG. 10 shows one embodiment of the electric circuit for controlling the braking arms, said circuit being shown in the inactive position of the braking arms at the moment of commencement of a pivotal movement of said arms to their active position and immediately after the ski boot was moved out of the binding.

The reversible motor 7 is supplied from a battery 15 which is interposed between the switching elements A1 and A2 (as shown in FIG. 10). The unit which serves to drive the braking arms 5 comprises an output pinion 16 which is coaxial with an output shaft 17, said shaft being driven by the motor 7 and adapted to cooperate with a set of pinions, two of which are capable of driving the braking arms 5 in rotation. This arm-actuating unit is associated with means for automatically stopping the motor 7 at the end of a pivotal displacement of the arms 5 toward either their active or inactive positions.

In the form of construction which is illustrated, the pinion 16 is disposed in meshing engagement on the one hand with a second pinion 18 having the same diameter (FIG. 6) and on the other hand with a pinion 19 having one-half of said diameter. Said pinion 19 is rigidly fixed to one of the pivot-pins 6 and is therefore capable of driving the corresponding arm 5 in rotation either in one direction or in the other, depending on the direction of rotation of the pinions 16 and 19.

As a complementary feature, the large pinion 18 is disposed in meshing engagement with a small pinion 21 which is identical with the pinion 19 and also mounted coaxially with the second pivot-pin 6 in order to drive the second braking arm 5 in rotation. The pivot-pins 6 as well as the shaft 22 of the pinion 18 pass through the rear transverse wall 23 of the heel-retaining unit 1 (as shown in FIGS. 1 and 2).

Said wall 23 is provided with a central rib 24 which is perpendicular to the surface of the ski and serves as a partition-wall between the two arms 5 when these latter are in the inactive position.

Figure 9:
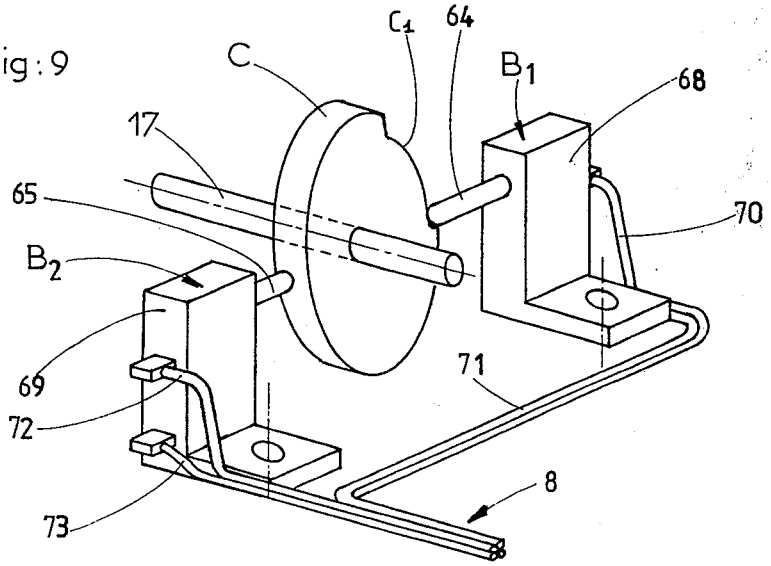
FIG. 9 is a partial perspective view to a larger scale showing the cam which is rigidly fixed to the output shaft of the motor and the two corresponding switches.

The aforementioned means for automatic stopping of the motor 7 comprise a cam C (as shown in FIGS. 3 to 5 and 9) which is rigidly coupled for rotation with the output shaft 17 and interposed between the pinion 16 and the motor 7. As shown in FIG. 9 and in FIG. 11, the cam C is a disk having a small radius over an angular sector C1 of 90° and the associated switches B1, B2 are constituted by contacts formed by rods 64, 65 in diametrically opposite relation on each side of the cam C, said rods being urged against the periphery of the cam by elastic members 66, 67 housed within casings 68, 69. Two electric leads 70, 71 and 72, 73 are connected to each switch B1, B2 and are joined together so as to form the multiple conductor 8 (shown in FIG. 9).

When the recessed portion C1 of the cam is located opposite to one of the rods 64, 65 of the switches B1, B2, said rod is caused by the thrust exerted by its spring to engage within the recessed portion C1 and the corresponding changeover switch is opened. Thus, in the angular position of the cam C shown in FIG. 9, the switch B2 is open whilst the switch B1 is closed since its rod 64 is in contact with that portion of the cam C which has the maximum diameter.

The casings 68, 69 of the switches B1, B2 are attached to the plate 4 in a suitable manner, for example by rivetting to the base of the heel-retaining unit.

The operation of the ski brake described in the foregoing is as follows.

Figure 12:
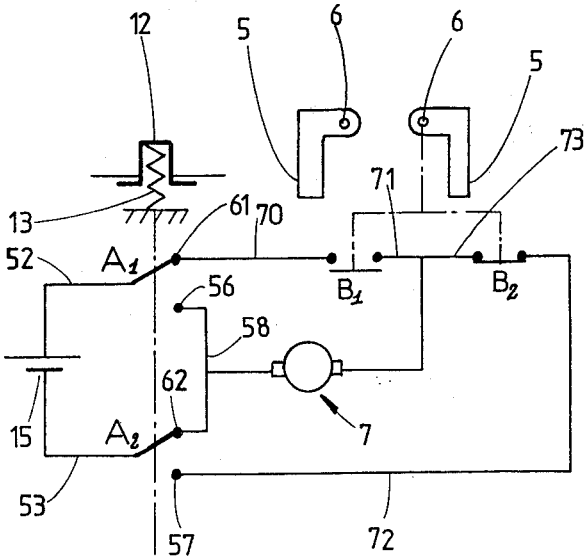
FIG. 12 shows the state of the electric circuit of FIG. 10 when the pusher is in the uplifted position and the braking arms have been lowered to their active position.
Figure 13:
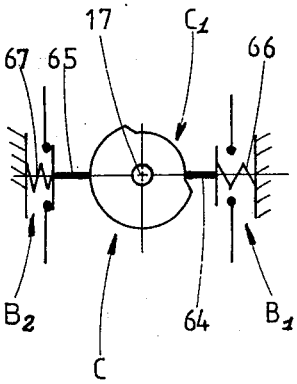
FIG. 13 is a view which is similar to FIG. 11 and shows the position of the cam and of the contactors corresponding to the state of the electric circuit illustrated in FIG. 12, that is, to the end of rotational displacement of the braking arms.

When the ski boot is not in position within the binding, for example as a result of a fall or when the ski is not in use, the brake and its control circuit are in the positions illustrated in FIGS. 8, 12 and 13. Under the action of its restoring spring 13, the pusher 12 is located in the top position in which its projects with respect to the cover 63 and holds the contacts of the switch elements A1, A2 against the upper contact studs 61, 62 by means of its annular flange 14. Correlatively, the cam C is located in the angular position shown in FIG. 13 in which the rod 64 of the switch B1 is thrust into position within the short-radius circular sector C1 under the action of its spring, with the result that the switch B1 is opened (as shown in FIG. 12) whereas the switch B2 is closed. Since the switch B1 is open, no current passes through the motor 7 and the arms 5 are located in their downwardly-displaced braking position.

Figure 14:
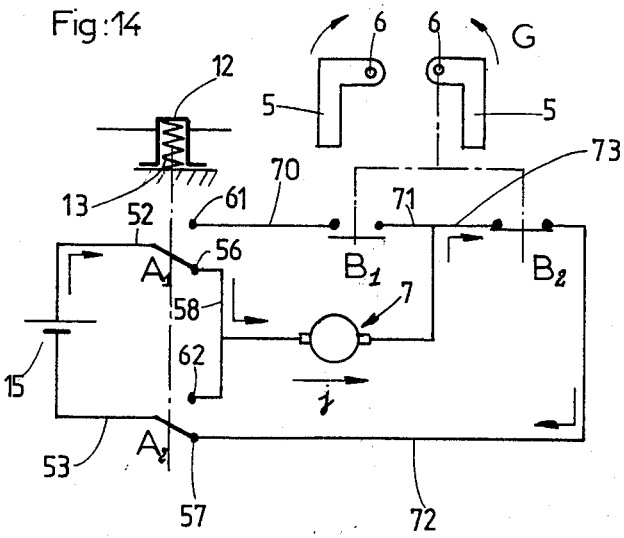
FIG. 14 shows the state of the electric circuit at the moment of commencement of the pivotal movement of the braking arms from their active position to their inactive position after downward displacement of the pusher as a result of engagement of the boot within the ski binding.
Figure 15:
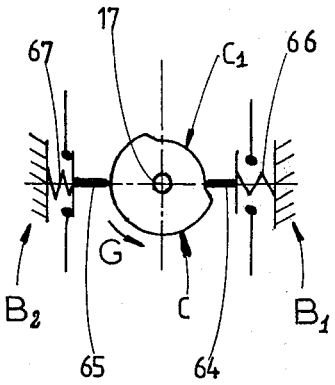
FIG. 15 is a view of the cam and of the associated contactors, this figure being similar to FIG. 13 and intended to show the direction of rotation of the cam when the pusher is displaced to its bottom position as illustrated in FIG. 14.
Figure 16:
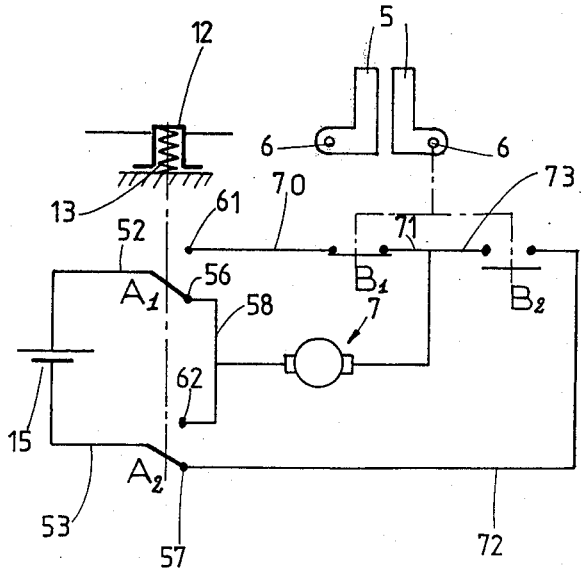
FIG. 16 shows the state of the electric circuit when the braking arms have carried out a pivotal movement from their active position of FIG. 14 to their withdrawn position above the ski.

When the skier resets the boot on the ski binding, the heel of the boot bears on the front portion 4*a* of the plate 4, the end-piece 2 being in the boot-retaining position shown in FIG. 3. The pusher 12 is displaced to the bottom position by the boot (as shown in FIG. 7), with the result that the strips 50, 51 of the switches A1, A2 are applied against the lower contact studs 56, 57 by virtue of their permanent curvature. Since the switch A2 is in the bottom position and the switch B2 is closed, a current j passes through the motor 7 (as shown in FIG. 14) in a direction such that the output shaft 17 of said motor produces an upward pivotal displacement of the arms 5 (as indicated by the arrows G in FIG. 14). The cam C carried by the shaft 17 also rotates in the direction of the arrow G (as shown in FIG. 15).

Figure 17:
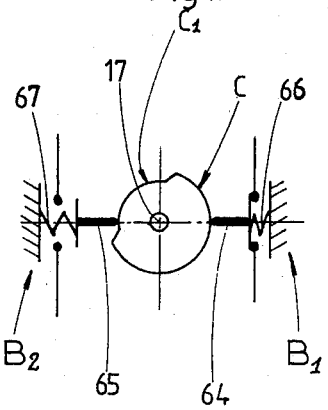
FIG. 17 is a view which is similar to FIG. 15 and shows the position of the cam and corresponding switches when the arms have returned to their inactive position of FIG. 16.

After the cam C has rotated through an angle of 90°, the rod 65 of the switch B2 comes opposite to the sector C1, with the result that the switch B2 opens (as shown in FIG. 17) whilst the switch B1 has closed.

At this moment, as a result of opening of the switch B2, the supply of current to the motor is cut-off whilst the arms have reached their inactive and uplifted position on completion of a pivotal displacement through 180° by virtue of the reduction ratio of 1:2 between the pinions 16, 18 and 19, 21.

When the boot escapes from the ski binding as a result either of torsional opening of the front stop or opening of the heel-retaining unit (forward-fall release or intentional removal of the boot), the pusher 12 is released, the annular flange 14 applies the ends of the strips 50, 51 against the corresponding contact studs 61, 62 (as shown in FIG. 8). Since the switch B1 is closed, a current i passes through the motor 7 in the direction opposite to the current j (shown in FIG. 10).

Figure 11:
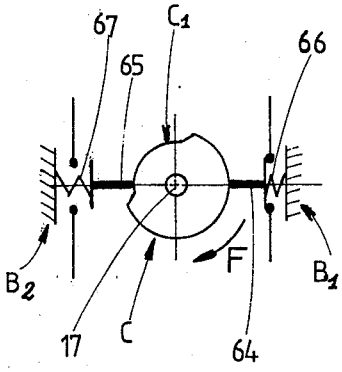
FIG. 11 is a schematic view in elevation showing the cam which is mounted on the output shaft of the motor and the associated contactors corresponding to FIG. 10.

The motor 7 then causes the shaft 17 and the arms 5 to carry out a movement of pivotal displacement in the direction of the arrows F (as shown in FIGS. 10 and 11). When the arms reach their active braking position on completion of a movement of rotation through an angle of 180°, the cam C has rotated through 90° in the direction of the arrow F, with the result that the switch B1 opens whereas the switch B2 has closed. By reason of the opening of the switch B1, the motor 7 is no longer supplied with current and consequently stops.

The operating cycle which has just been described is resumed when the skier resets the boot in its ski binding.

Aside from the very small and practically negligible elastic action of the restoring member 13 on the ski boot, no parasitic force is exerted on the boot within the ski brake in accordance with the invention, thus constituting a very appreciable advantage over brakes of the prior art. In point of fact, this absence of parasitic force results in greater ease and convenience of boot engagement as well as better quality and improved operation of the ski binding while skiing is in progress.

It should further be noted that the pusher 12 is capable of displacement at right angles to the surface of the ski 3 over a predetermined range of travel before actuating the double-throw changeover contactor A1, A2. This prevents accidental brake application in the event that the heel-retaining unit is provided with a long range of elastic travel.

The invention is not limited to the embodiment hereinabove described and may accordingly extend to alternative forms of construction. Thus the motor and the system for actuating the braking arms as well as the arms themselves could be so arranged that the pivot-pins of said arms are located transversely with respect to the ski. In this case the arms would project outwards with respect to the ski as in the majority of known designs. Moreover, the brake in accordance with the invention can be integrated with the front stop or with a ski binding of the rotatable casing type described in U.S. Pat. No. 4,182,524. Alternatively, the brake can even be completely independent of the ski binding, in which case the arm-actuating system is housed within an independent casing.

The drive unit 7 which equips the embodiment described by way of example in the foregoing is simply an electric motor with an incorporated reduction gear mechanism (reduction-gear motor). However, it would be possible to employ another unit of the electric drive type such as a rotary electromagnet, for example.

Finally, it would be an advantage to interpose a torque-limiting elastic coupling on the shaft 17 between the cam C and the pinion 16 in order to permit rotation of the motor 7 and of the cam C in spite of any possible jamming of one of the arms 5 by an obstacle (such as a stone, root and the like). A device of this type is within the capacity of anyone versed in the art and has not been illustrated for the sake of simplification.

What is claimed is:

1. A ski brake adapted to be associated with a ski binding for a ski boot, comprising a pair of rotatably mounted braking arms movable between an inactive position and an active braking position, and control means for actuating said braking arms from one position to the other, said control means comprising a reversible electric motor, a drive unit connecting said motor to said rotatably mounted arms, a source of power, spring biased switch means, a pusher button adapted to be positioned beneath the ski boot for actuating said spring biased switch means, and means interconnecting said motor to said source of power through said switch means in such a manner that when said switch means is actuated by the ski boot against the action of the spring said motor moves said braking arms through said drive unit to their inactive position, and when said switch means is biased by said spring means in the absence of the ski boot, said motor moves said braking arms through said drive unit to their active braking position.

2. Ski brake according to claim 1, in which said spring biased switching means is a double-pole double-throw switch.

3. Ski brake according to claim 2, in which said drive unit comprises an output pinion on the drive shaft of the motor, and pinions interconnecting said output pinion with said rotatably mounted braking arms, in combination with switch means operable through said drive unit for disconnecting said motor from said source of power whenever said braking arms have been displaced to either their active or inactive positions.

4. Ski brake according to claim 3, in which said last means comprises a cam coupled for rotation with the output shaft of the motor, and a pair of cam-operated switches in the electric motor circuit, the position of said switches relative to said cam being such that closure of one switch by the cam is ensured while the other switch is open to supply current to the motor in one direction for rotation of the brake arms to one position until the cam has moved through a predetermined angle at which time said one switch is opened and said other switch is closed, thus automatically stopping the rotation of the braking arms either in their active position or in their inactive position.

5. Ski brake according to claim 4, in which said cam is a disc having a short radius of an angular sector of approximately 90° and the associated switches are constituted by contacts located in diametrically opposite relation on each side of the cam in combination with means urging said contacts against said cam in such a manner as to ensure that one of the contacts is opened when it is located within the short-radius angular sector while the other contact is closed by that portion of the cam external to said angular sector, and in which the reduction ratio of the pinions connected to said braking arms is such that rotation of the braking arms through an angle of approximately 180° corresponds to a rotation of the cam through an angle of approximately 90°.

6. Ski brake according to claim 1, in combination with a hollow plate adapted to be secured to the ski and enclosing said pusher button spring biased switch means and the means interconnecting the motor to said switch means.

7. Ski brake according to claim 1, in which said braking arms are elbowed so as to have substantially the shape of an L and in which said braking arms are mounted on axes parallel to one another and to the longitudinal axis of the ski.

8. Ski brake according to claim 1, in combination with a hollow body supporting said ski binding and enclosing said drive unit.

* * * * *